US005730858A

United States Patent [19]

Olivier et al.

[11] Patent Number: 5,730,858

[45] Date of Patent: Mar. 24, 1998

[54] PROCESS FOR CONVERTING WAX-CONTAINING HYDROCARBON FEEDSTOCKS INTO HIGH-GRADE MIDDLE DISTILLATE PRODUCTS

[75] Inventors: Catherine Olivier, Ittre; Jacques Grootjans, Leefdaal, both of Belgium

[73] Assignee: Fina Research, S.A., Feluy, Belgium

[21] Appl. No.: 819,933

[22] Filed: Mar. 18, 1997

[30] Foreign Application Priority Data

Apr. 1, 1996 [BE] Belgium ..... 96105170

[51] Int. Cl.[6] ..... C10G 73/02; C10G 67/04; C10G 67/08

[52] U.S. Cl. ..... 208/28; 208/27; 208/30; 208/31; 208/33; 208/87; 208/109; 208/110; 585/740; 585/750; 585/752

[58] Field of Search ..... 208/27, 28, 30, 208/31, 33, 109, 110, 87; 585/740, 750, 752

[56] References Cited

U.S. PATENT DOCUMENTS

| | | | |
|---|---|---|---|
| 3,224,955 | 12/1965 | Anderson | 208/28 |
| 3,719,585 | 3/1973 | Brasher et al. | 208/33 |
| 5,413,695 | 5/1995 | Miller | 208/28 |

*Primary Examiner*—Glenn Caldarola
*Assistant Examiner*—Bekir L. Yildirim
*Attorney, Agent, or Firm*—Michael J. Caddell; M. Norwood Cheairs

[57] ABSTRACT

The wax-containing hydrocarbon feedstocks are pre-treated by contacting them with a homogeneous solution containing 1–5 vol. % of an acid diluted in an alcohol/water mixture (preferably containing 60–90 vol. % alcohol). The pre-treated feedstock is then contacted, in the presence of hydrogen, with at least two catalysts in sequence and with no intermediate separation, comprising at least one hydrodewaxing catalyst and one hydrocracking catalyst, to recover high-grade middle distillates.

1 Claim, No Drawings

PROCESS FOR CONVERTING WAX-CONTAINING HYDROCARBON FEEDSTOCKS INTO HIGH-GRADE MIDDLE DISTILLATE PRODUCTS

The present invention relates to a process for reducing the wax content of wax-containing hydrocarbon feedstocks. More particularly, the invention relates to a synergistic improvement with a pretreatment step with a dilute acid solution.

Many liquid hydrocarbon feedstocks contain relatively high concentrations of straight chain and slightly branched chain aliphatic compounds having between 8 and 40 carbon atoms, commonly indicated as waxes. These compounds tend to crystallize on cooling of the hydrocarbon oil, a crystallization which is quite frequently sufficient to hinder the flow of the liquid hydrocarbon and prevent it from being pumped or transmitted from one location to another. The temperature at which the hydrocarbon oil will not flow is commonly referred to as the "pour point". The temperature at which a cloud or haze of wax crystals is formed in the oil is commonly referred to as the "cloud point". These parameters are determined by way of standardized test procedures.

One way of converting such wax-containing feedstocks into high-grade products is by means of catalytic conversion, a process in which the waxes and other high-molecular weight hydrocarbon components are cracked in the presence of hydrogen to lower-molecular weight components. In this way middle distillates can be produced, and because of the ever increasing need for middle distillates, such as jet fuel, diesel fuel, and heating oil, it is of major importance to have good processes for their production, i.e., processes which effect efficient conversion of the objectionable high-molecular weight feedstock components to give middle distillate products with desirable properties.

Such processes are known e.g. from U.S. Pat. No. 4,743,354-A and from WO-9510578-A, each of which discloses a specific combination of hydrocracking and dewaxing or hydrodewaxing.

There is however an ongoing demand for middle distillate products having improved low-temperature properties, i.e. a lower freeze point in the case of jet fuel and a lower pour point as well as a lower cloud point in the case of diesel fuel and heating oil.

It is an object of the invention to provide a process whereby a waxy hydrocarbon feedstock is converted to middle distillate products having lower operating temperatures.

The Applicant has now surprisingly found that these and other objects can be fulfilled by combining the known processes with a pre-treatment step.

In accordance with the foregoing, the invention provides a process for converting a wax-containing hydrocarbon feedstock containing a substantial proportion of hydrocarbonaceous material boiling above 343° C. into a middle distillate product having a reduced wax content compared with that of the feedstock, which process comprises (a) contacting the feedstock with a homogeneous solvent mixture comprising a dilute aqueous acid solution, the acid being an inorganic acid or an organic acid, and an alcohol having from 1 to 6 carbon atoms, the volume ratio of alcohol/dilute aqueous acid solution being from 90/10 to 10/90, the volume ratio of solvent mixture/feedstock being from 0.5 to 5, and the acid content of said solvent mixture being from 1 to 5 vol %;

(b) recovering the feedstock;

(c) contacting the feedstock in the presence of hydrogen with at least two catalysts in sequence, with no intermediate separation, said catalysts being selected from (1) at least one crystalline, intermediate pore size molecular sieve selected from the group of metallosilicates and silicoaluminophosphates and having a pore diameter in the range of 0.5 to 0.7 nm, in a hydrodewaxing zone under conditions of elevated temperature and pressure; and (2) at least one hydrocracking catalyst containing a carrier, at least one hydrogenation metal component selected from Group VIB and Group VIII of the Periodic Table, and a large pore zeolite having a pore diameter in the range of 0.7 to 1.5 nm, in a hydrocracking zone under conditions of elevated temperature and pressure;

(d) recovering the middle distillate product having improved low-temperature properties.

Examples of feedstocks suitable for use in the process according to the invention include waxy raffinates, waxy gasoils, waxy distillates, and waxy products from thermal and catalytic cracking operations. Generally, these feedstocks contain from 2 to 20 wt. % of wax and have their pour points in the range of 0° to 55° C. The boiling ranges of these feedstocks usually are such that a substantial proportion of the feedstock, i.e., at least 20 wt. %, boils above 343° C. The boiling ranges mostly are in the range of 180° to 600° C.

It is known, e.g. from WO-9510578-A, that if the feedstock contains objectionably large quantities of nitrogen, it may be subjected to a conventional hydrodenitrogenation using a hydrotreating catalyst which will normally comprise Group VIB and Group VIII metal components on a porous inorganic refractory oxide support, prior to being passed to the hydrocracking zone; as circumstances require, such a hydrotreatment step may be carried out separately, with the formed hydrogen sulphide and/or ammonia being removed from the effluent, or else the entire effluent may be recovered from the hydrotreatment zone and used as feedstock in the present invention. Such a hydrodenitrogenation step however requires operation at high pressure and temperature followed by a separation step, resulting in large operating costs; there is thus a need in the art for a process which is more economical yet which enables to treat feedstocks containing objectionably large quantities of nitrogen.

The feedstock is first contacted with a homogeneous solvent mixture comprising a dilute aqueous acid solution, the acid being an inorganic acid or an organic acid, and an alcohol having from 1 to 6 carbon atoms, the volume ratio of alcohol/dilute aqueous acid solution being from 90/10 to 10/90, the volume ratio of solvent mixture/feedstock being from 0.5 to 5, and the acid content of said solvent mixture being from 1 to 5 vol %. Preferably, that pre-treatment is carried out at a temperature of from 5° to 85° C., most preferably from 45° to 85° C. Also, it is preferred that the mixture contains at least 10% alcohol, more preferably at least 50 vol % and most preferably between 60 and 90 vol %. Sulphuric acid is preferred for ease of storage and handling, and because impurities that might remain do not poison the catalysts. The volume ratio of solvent mixture to feedstock is preferably from 1:1 to 2:1.

The pretreatment step is preferably carried out continuously, using a mixer-settler and passing the feedstock+acid-solvent mixture into a separation column in order to recover the pretreated feedstock.

The pretreated feedstock is then contacted, in the presence of hydrogen, with at least two catalysts in sequence, with no intermediate separation, said catalysts being selected from (1) at least one crystalline, intermediate pore size molecular sieve selected from the group of metallosilicates and silicoaluminophosphates and having a pore diameter in the range of 0.5 to 0.7 nm, in a hydrodewaxing zone under conditions of elevated temperature and pressure; and (2) at least one hydrocracking catalyst containing a carrier, at least one hydrogenation metal component selected from Group VIB and Group VIII of the Periodic Table, and a large pore zeolite having a pore diameter in the range of 0.7 to 1.5 nm, in a hydrocracking zone under conditions of elevated temperature and pressure.

The sequence, as used herein, can be any type of sequence, the most simple ones being:

(1) then (2);

(2) then (1);

(1) then (2) then (1); and (2) then (1) then (2).

Each bed of catalyst (1) or (2) can itself be a mixture or a sequence of catalysts (1) respectively (2). Further, each bed of catalyst (1) or (2) can be the same or different than each other bed of catalyst (1) respectively (2) in a sequence. Also, mixtures of catalysts (1) and (2) can also be envisaged although less preferred.

In the hydrodewaxing zones, the feedstock stream is contacted with dewaxing catalyst (1) in the presence of hydrogen. Generally, the temperature in this zone is in the range of 260° to 455° C., preferably in the range of 315° to 427° C.; the total pressure usually is between 3 and 21 MPa, preferably between 5 and 15 MPa; the liquid hourly space velocity commonly is of from 0.3 to 10, preferably of from 0.5 to 5, while the hydrogen flow rate generally is above 89 $m^3/m^3$ of feedstock, preferably between 265 and 1780 $m^3/m^3$.

The essential component of the dewaxing catalyst is a crystalline, intermediate pore size molecular sieve having a pore diameter in the range of 0.5 to 0.7 nm, selected from the group of metallosilicates and silicoaluminophosphates. Such molecular sieves can also be characterized by means of the Constraint Index, which will have a value in the range of 1 to 12. The Constraint index is indicative of the shape selective properties of the zeolite; for its determination reference is made to U.S. Pat. No. 4,016,218, U.S. Pat. No. 4,711,710, and U.S. Pat. No. 4,872,968. Frequently, the pores of these materials are defined by 10-membered rings of oxygen atoms.

Useful metallosilicates include borosilicates (as described, for example, in EP-A-0,279,180), iron silicates (as described, for example, in U.S. Pat. No. 4,961,836) and aluminosilicates. Useful silicoaluminophosphates include SAPO-11, SAPO-31, SAPO-34, SAPO-40, and SAPO-41, with SAPO-11 being preferred; for a description of several of these silicoaluminophosphates reference is made to U.S. Pat. No. 4,440,871.

Also preferred are the aluminosilicates. Examples of these include TMA-offretite (described in *Journal of Catalysis*, 86 (1984) 24–31), ZSM-5 (described in U.S. Pat. No. 3,702,886), ZSM-11 (described in U.S. Pat. No. 3,709,979), ZSM-12 (described in U.S. Pat. No. 3,823,449), ZSM-23 (described in U.S. Pat. No. 4,076,842), ZSM-35 (described in U.S. Pat. No. 4,016,245), and ZSM-38 (described in U.S. Pat. No. 4,046,859). Preference is given to ZSM-5. The silica:alumina molar ratio may be in the range of 12 to 500, with ratios in the range of 20 to 300, more particularly 30 to 250, being preferred. The preparative process usually yields the aluminosilicates in the form of their sodium salts, and it is recommended to replace as many sodium ions as possible with hydrogen ions, e.g., by means of one or more exchanges with ammonium ions, followed by a calcination step.

Next to the molecular sieve, the hydrodewaxing catalyst will usually contain a binder material in the form of a porous, inorganic refractory oxide, such as (gamma) alumina. The proportion of molecular sieve in the molecular sieve/binder composition may vary in the range of 2 to 90 wt. %.

In addition, the dewaxing catalyst may contain one or more hydrogenation metal components selected from the metals, oxides, and sulphides of the Group VIB and Group VIII metals. incidentally, if the dewaxing catalyst contains said one or more hydrogenation metal components, it may also be referred to as a hydrodewaxing catalyst, but for the purpose of this specification the term "dewaxing catalyst" is used to designate both of these embodiments.

In this context, it should also be noted that throughout the specification the term "hydrodewaxing zone" has been used, irrespective of whether the dewaxing catalyst contains a hydrogenation metal component or not, this because of the presence of hydrogen in the zone.

The most suitable hydrogenation metal components are selected from the group consisting of the metals, oxides, and sulphides of platinum, palladium, nickel, the combination of nickel and tungsten, and the combination of cobalt and molybdenum. In general, the amount of these metals is of from 5 to 30 wt. % of Group VIB metal component, calculated as trioxide, and of from 0.3 to 8 wt. % of non-noble Group VIII metal component, calculated as oxide. If a noble metal is employed, the amount thereof may be in the range of 0.1 to 2 wt. %.

The preparation of the dewaxing catalyst may be carried out in an otherwise known manner by mixing the molecular sieve with a binder precursor material such as an alumina hydrogel—e.g., peptised Catapal®, peptised Versal®, or a precipitated alumina gel—extruding the mixture, and then calcining the extrudates.

If it is desired to include one or more hydrogenation metal components, conventional techniques, such as incorporating an appropriate solid or a solution containing one or more metal component precursors into the molecular sieve/binder precursor mixture prior to extrusion, or impregnating the metal-free extrudates with a solution containing one or more metal component precursors, may be employed.

Also, a phosphorus component may be part of the dewaxing catalyst. One convenient way of introducing the phosphorus component involves impregnating the extrudates—whether or not containing one or more hydrogenation metal components—with a solution containing an appropriate amount of a phosphorus-containing compound, such as phosphoric acid.

Evidently, if the catalyst is to be made to contain one or more hydrogenation metal components as well, another convenient way to introduce the phosphorus component is to include an appropriate amount of a phosphorus-containing compound, such as phosphoric acid, into an impregnation solution containing a precursor or precursors of said one or more hydrogenation metal components. In an alternative method it is contemplated to include a phosphorus-containing compound into the mixture comprising the molecular sieve and the binder precursor prior to the extrusion step.

In the hydrocracking zones, the feedstock stream is contacted with hydrocracking catalyst (2) in the presence of hydrogen. In general, the temperature in this zone is in the range of 260° to 455° C., preferably in the range of 315° to 427° C.; the total pressure usually is between 3 and 21 MPa, preferably between 5 and 15 MPa; the liquid hourly space velocity (LHSV) commonly is in the range of 0.3 to 8, preferably in the range of 0.5 to 3, and the hydrogen flow rate generally is higher than 89 $m^3/m^3$ of feedstock, preferably between 265 and 1780 $m^3/m^3$.

Use may be made of all hydrocracking catalysts which contain a large pore zeolite (i.e. a zeolite having a pore diameter in the range of 0.7 to 1.5 nm), which catalysts are known to be suitable for use in producing middle distillates.

The suitable carrier materials in such catalysts include alumina, silica-alumina, dispersions of silica-alumina in alumina, titania-alumina: tin oxide-alumina, and aluminophosphate.

The suitable hydrogenation metal component is selected from the metals, oxides, and sulphides of the Group VIB and Group VIII elements. The most suitable metal component is selected from the group consisting of the metals, oxides, and sulphides of platinum, palladium, nickel, cobalt, molybdenum, and tungsten; in addition, combinations of these metal components may be employed, in particular nickel and tungsten, cobalt and molybdenum, and nickel and molybdenum components.

The amount of metal component in the hydrocracking catalyst generally is in the range of 0.2 to 2.0 wt. % when a noble metal is employed (calculated on the basis of the metal); if Group VIB and other Group VIII metals are used, they are used in amounts in the respective ranges of 5 to 30 wt. % calculated as trioxide and 0.5 to 15 wt. % calculated as oxide.

If desired, the catalyst may also contain a phosphorus component; it will be clear to the skilled person that one convenient way of introducing such a phosphorus component into the catalyst is to incorporate an appropriate amount of a phosphorus-containing compound, such as phosphoric acid, into an impregnation solution containing a precursor or precursors of the one or more hydrogenation metal components.

Suitable large pore zeolites include zeolite X, zeolite Y, zeolite L, zeolite omega, ZSM-4, zeolite beta, mordenite, and modifications thereof. The pore diameter of these zeolites is in the range of 0.7 to 1.5 nm, with the preferred range being 0.7 to 1.2 nm. Preferred among these zeolites are zeolite Y and modifications thereof, that is, Y type zeolites having a unit cell size in the range of 2.420 to 2.475 nm and a silica:alumina molar ratio of from 3.5 to 100.

The suitable Y-type zeolite is exemplified by the Y zeolite itself, which is a zeolite having a unit cell size in the range of 2.452 to 2.475 nm and a silica:alumina molar ratio in the range of 3.5 to about 7; for a description of this zeolite reference is made to U.S. Pat. No. 3,130,007. Other examples include ultra-stabilised Y zeolites prepared by subjecting a Y zeolite to one or more (steam) calcinations combined with one or more ammonium ion exchanges. The latter zeolites have a unit cell size of between 2.420 and about 2.455 nm and a silica:alumina molar ratio in the lattice of up to 100, preferably up to 60. For a description of such ultrastable Y zeolites reference is made to U.S. Pat. No. 3,293,192, U.S. Pat. No. 3,449,070, and U.S. Pat. No. 3,929,672.

Such ultrastable Y zeolites are also commercially available under such trade designations as LZY-82 (prepared in accordance with U.S. Pat. No. 3,929,672) and LZ-10 (both manufactured by Union Carbide Corporation/UOP); LZ-10 is a modified Y zeolite which has a silica:alumina ratio in the range of 3.5 to 6, a surface area in the range of 500 to 700 $m^2/g$, a unit cell size in the range of 2.425 to 2.435 nm, a water adsorption capacity of less than 8 wt. % at 25° C. and a water pressure of 4.6 mm Hg, and less than 20% of the ion exchange capacity of an unmodified Y zeolite of the same silica:alumina ratio.

Another suitable ultrastable Y zeolite is the one described in GB-A-2,114,594; its preparation also involves a combination of ammonium exchange and steam calcination, but instead of the steam calcined zeolite being further exchanged with ammonium ions, it is leached with an organic chelating agent, such as EDTA, or an organic or inorganic acid to remove extra-framework alumina. Yet another suitable ultrastable Y zeolite may be obtained by treating a Y zeolite with diammonium hexafluorosilicate in the manner disclosed in U.S. Pat. No. 4,503,023; these zeolites, which are known by the designation LZ-210, are also available from Union Carbide Corporation/UOP and have a unit cell size in the range of 2.420 to 2.455 nm and a silica:alumina molar ratio (SAR) in the lattice in the range of 8 to 60.

When used in its acidic form, the Y type zeolite has a sodium oxide content which is generally less than 0.5 wt. %, preferably less than 0.2 wt. %.

The amount of large pore zeolite in the hydrocracking catalyst composition usually is in the range of 5 to 50 wt. %.

The preparation of the hydrocracking catalyst composition may be carried out in the usual manner, including well-known comulling, extruding, calcination, and impregnation techniques.

The entire effluent from each zone is passed to the next zone in the sequence, i.e. there is no separation. The reaction conditions (temperature, pressure, LHSV, and hydrogen partial pressure) in the various zones may be identical, but this is not required. The total pressure and the hydrogen flow rate in general will be the same, the LHSV for all catalyst beds collectively may vary in the ratio range of 0.2 to 5, and the temperature difference between two catalyst beds normally does not exceed 50° C.

In order to obtain the best possible effect with the process according to the invention the reaction conditions of the various zones must be carefully selected to provide the desired conversion rates and low pour point, cloud point, and/or freeze point, depending on the circumstances, while minimizing the conversion to undesired lower-boiling products. Generally, the optimum reaction conditions will depend on the activity of the catalysts, the nature of the feedstock, and the desired balance between conversion and selectivity, which are inversely correlated. Higher conversion will generally result in lower selectivity. The optimization of the reaction conditions is well within the scope of the artisan's skill.

Preferably, the reaction conditions in the various zones are so selected or matched that a product is obtained of which a substantial proportion, preferably over 50 wt. %, has a boiling point below 371° C., more specifically, between 149° and 371° C. in the middle distillate range.

In commercial practice it is often desirable to minimize the amount of product boiling below the middle distillate range. In those cases it is preferable to select the reaction conditions such that the overall conversion of feedstock constituents into product components boiling at or below 149° C. is not more than 50 wt. %, preferably not more than 30 wt. %, most preferably not more than 20 wt. %.

Optionally, the effluent, or a portion of it, may be subjected to catalytic hydroprocessing, that is, hydrogenation and/or mild hydrocracking. This may be done by passing the entire effluent over a hydroprocessing catalyst bed arranged in a hydroprocessing zone situated downstream of the above described sequence of zones. Alternatively, one may pass only a part of said effluent over the downstream hydroprocessing catalyst, the remainder being sent to the middle distillate recovery unit. Alternatively, the product stream to be hydroprocessed may be deprived of its gaseous components, notably hydrogen sulphide and/or ammonia, after which fresh hydrogen is added prior to the hydroprocessing step.

Typical hydroprocessing conditions include a temperature in the range of 260° to 455° C., preferably 260° to 380° C., a total pressure in the range of 2 to 21 MPa, a liquid hourly space velocity in the range of 0.3 to 8, and a hydrogen flow rate higher than 89 $m^3/m^3$, preferably in the range of 100 to 2000 $m^3/m^3$. Normally, the hydroprocessing catalyst will comprise a porous inorganic refractory oxide support, such as alumina, silica-alumina, or silica-alumina dispersed in alumina, and at least one metal component selected from Group VIB and Group VIII including the noble metals.

Such an after-treatment may be of advantage if a product is desired which has to meet certain requirements with regard to, for example, cetane index and/or oxidation stability under the influence of ultraviolet light and it is found that the product obtained after hydrocracking and dewaxing according to the invention fails to met these requirements. Such a situation may arise, e.g., if in the hydrodewaxing zone use is made of a catalyst which does not contain a hydrogenation metal component or hydrogenation metal components, but even when it does, the amount of these metals components and/or the severity of the process conditions may prove insufficient to effect the hydrogenation of unsaturated compounds needed to obtain the required cetane index and/or oxidation stability.

The effluent from the sequence of zones, or from the subsequent hydroprocessing zone if the effluent, or a part of it, has been subjected to subsequent hydroprocessing, has a strongly decreased wax content, and as stated above, a substantial proportion of it boils below 371° C. The desired product is recovered from the effluent, if need be by fractionation. If the desired product is a jet fuel, it will normally boil between about 149° and about 288° C. and have a relatively low freeze point, typically below −40° C., and preferably below −60° C. If the desired product is a diesel fuel or a heating oil, it will typically boil between about 200° and 371° C., or have a relatively low pour point and a relatively low cloud point, typically below 5° C.

The following Examples illustrate the invention.

In the Examples, the cloud points are determined in accordance with ASTM D2500, the pour points are determined in accordance with ASTM D97, the bromine index is determined in accordance with ASTM D2710, the colour is determined in accordance with ASTM D1500, and the cetane index is determined in accordance with ASTM D976. Distillation figures were obtained in accordance with ASTM D86 or D2892 as indicated. CFPP is used for "cold filter plugging point".

EXAMPLE 1

A feedstock the characteristics of which are given in Table 1 (first column) was processed in accordance with the process of the invention.

TABLE 1

| properties | | feedstock | pre-treated |
|---|---|---|---|
| sulphur | (ppm) | 2866 | 2736 |
| density at 15° C. | (g/ml) | 0.886 | 0.8841 |
| basic nitrogen | (ppm) | 116 | 12 |
| total nitrogen | (ppm) | 404 | 184 |
| viscosity at 40° C. | ($10^{-6}m^2/g$) | 9.7 | 9.7 |
| cetane index | (—) | 47.1 | 47.5 |
| colour | (—) | <1 | <1 |
| cloud point | (°C.) | 8 | 7 |
| pour point | (°C.) | 0 | −15 |
| CFPP | (°C.) | 10 | 8 |
| aniline point | (°C.) | 71.2 | 71.7 |

TABLE 1-continued

| properties | | feedstock | pre-treated |
|---|---|---|---|
| C3 concentration | (wt %) | <0.01 | <0.01 |
| iC4 concentration | (wt %) | <0.01 | <0.01 |
| nC4 concentration | (wt %) | <0.01 | <0.01 |
| HPLC aromatics | | | |
| mono | (wt %) | 27.8 | 24.8 |
| di | (wt %) | 15 | 11.1 |
| tri | (wt %) | 3.5 | 1.4 |
| total | (wt %) | 46.3 | 37.3 |
| distillation ASTM D86 | | | |
| IBP | (°C.) | 280 | 274 |
| 5 vol % | (°C.) | 305 | 307 |
| 10 vol % | (°C.) | 313 | 315 |
| 20 vol % | (°C.) | 321 | 323 |
| 30 vol % | (°C.) | 329 | 331 |
| 40 vol % | (°C.) | 334 | 336 |
| 50 vol % | (°C.) | 339 | 340 |
| 60 vol % | (°C.) | 343 | 345 |
| 70 vol % | (°C.) | 347 | 349 |
| 80 vol % | (°C.) | 353 | 355 |
| 90 vol % | (°C.) | 362 | 363 |
| 95 vol % | (°C.) | 368 | 371 |
| FBP | (°C.) | 371 | 375 |
| distilled | (vol %) | 98 | 98 |
| residue | (vol %) | 2 | 2 |

The feedstock was pretreated by introducing in a mixer-settler:

100 parts by volume (pbv) of feedstock, 19.8 pbv of water, 2.1 pbv of sulphuric acid (95%), and 178.1 pbv of methanol.

After mixing 1 hour at 60° C. and 800 rpm, the mixture was settled and a pretreated feedstock was recovered which had characteristics as given in Table 1 (second column).

The feedstock was then introduced into a sequence of zones.

The first and third catalyst beds consisted of a hydrocracking catalyst containing about 4 wt. % of nickel component (calculated as NiO), 20 wt. % of a molybdenum component (calculated as $MoO_3$) impregnated on extrudates consisting of activated alumina; prior to use, the catalyst was presulphided using a mixture of hydrogen and hydrogen sulphide under conventional temperature programming conditions.

The second catalyst bed consisted of a dewaxing catalyst containing 20 wt. % of an alumina carrier and 80 wt. % of silicalite.

The volume of each catalyst bed was as follows :

first bed: 35.6 vol % (top)

second bed: 45.2 vol % third bed: 19.2 vol % (bottom)

The flow was from the top downwards. The entire effluent from each bed was passed to the next one.

The operating conditions were as follows:

| | | |
|---|---|---|
| - temperature | (°C.) | 375 |
| - LHSV (total) | | 0.8 |
| - gauge pressure | (MPa) | 4.14 |
| - $H_2$/feedstock | (Nl/l) | 423 |

The hydrogen used was refinery hydrogen (85 vol % hydrogen and 15 vol % methane).

The total liquid effluent has been recovered. Its characteristics were as indicated in Table 2 (first column) under TLP (total liquid product). Characteristics of two fractions have also been indicated.

TABLE 2

| TLP | | Example 1 | Comparative example |
|---|---|---|---|
| colour | | <6 | <1.5 |
| C3 concentration | (wt %) | 0.02 | 0.02 |
| iC4 concentration | (wt %) | 0.05 | 0.03 |
| nC4 concentration | (wt %) | 0.11 | 0.03 |
| density at 15° C. | (g/ml) | 0.8824 | 0.8843 |
| cloud point | (°C.) | −23 | −7 |
| pour point | (°C.) | −45 | −39 |
| sulphur | (ppm) | 273 | 383 |
| total nitrogen | (ppm) | 115 | |
| basic nitrogen | (ppm) | 4 | |
| TBP distillation ASTM D2892 | | | |
| IBP-150 | (wt %) | 5.7 | 3 |
| 150+ | (wt %) | 94.3 | 97 |
| IBP-150 | | | |
| density at 15° C. | (g/ml) | 0.7117 | 0.7053 |
| basic nitrogen | (ppm) | n.d. | 7 |
| 150+ | | | |
| density at 15° C. | (g/ml) | 0.8937 | 0.891 |
| sulphur | (ppm) | 267 | 366 |
| pour point | (°C.) | −51 | −15 |
| cloud point | (°C.) | −21 | −7 |
| CFPP | (°C.) | 5 | 5 |
| total nitrogen | (ppm) | 123 | 341 |
| basic nitrogen | (ppm) | 17 | 54 |
| viscosity at 40° C. | ($10^{-6}m^2/g$) | 10.2 | 9.5 |
| cetane index | (—) | 45.2 | 45.7 |
| colour | (—) | <2 | <2 |
| aniline point | (°C.) | 66.2 | 66.9 |
| HPLC aromatics | | | |
| mono | (wt %) | 29.4 | 27.6 |
| di | (wt %) | 11.2 | 11.6 |
| tri | (wt %) | 1.3 | 2.2 |
| total | (wt %) | 41.9 | 41.4 |

The mass balances are indicated in Table 3 (first column)

TABLE 3

| Mass balance (in parts by weight) | Example 1 | Comparative Example |
|---|---|---|
| reactor in | | |
| feedstock | 100 | 100 |
| H2 | 4.62 | 4.33 |
| CH4 | 6.16 | 6.93 |
| reactor out | | |
| H2 | 4.21 | 4.12 |
| H2S | 0.18 | 0.17 |
| C1–C2 | 5.45 | 6.09 |
| C3 | 1.16 | 1.02 |

TABLE 3-continued

| Mass balance (in parts by weight) | Example 1 | Comparative Example |
|---|---|---|
| C4 | 2.69 | 2.18 |
| C5–150 | 7.18 | 5.17 |
| 150+ | 89.91 | 92.51 |
| 150+ conversion (%) | 10.09 | 7.48 |
| H2 chemical consumption (NL/L) | (36) | (33.1) |

First comparative example

Example 1 was repeated but the pretreatment step was omitted. The results are indicated in Table 2 (second column) and Table 3 (second column).

The results show that improved properties are obtained even when the first catalyst bed is a hydrotreatment catalyst.

We claim:

1. Process for converting a wax-containing hydrocarbon feedstock containing a substantial proportion of hydrocarbonaceous material boiling above 343° C. into a middle distillate product having a reduced wax content compared with that of the feedstock, which process comprises (a) contacting the feedstock with a homogeneous solvent mixture comprising a dilute aqueous acid solution, the acid being an inorganic acid or an organic acid, and an alcohol having from 1 to 6 carbon atoms, the volume ratio of alcohol/dilute aqueous acid solution being from 90/10 to 10/90, the volume ratio of solvent mixture/feedstock being from 0.5 to 5, and the acid content of said solvent mixture being from 1 to 5 vol %;

(b) recovering the feedstock;

(c) contacting the feedstock in the presence of hydrogen with at least two catalysts in sequence, with no intermediate separation, said catalysts being selected from (1) at least one crystalline, intermediate pore size molecular sieve selected from the group of metallosilicates and silicoaluminophosphates and having a pore diameter in the range of 0.5 to 0.7 nm, in a hydrodewaxing zone under conditions of elevated temperature and pressure; and (2) at least one hydrocracking catalyst containing a carrier, at least one hydrogenation metal component selected from Group VIB and Group VIII of the Periodic Table, and a large pore zeolite having a pore diameter in the range of 0.7 to 1.5 nm, in a hydrocracking zone under conditions of elevated temperature and pressure;

(d) recovering the middle distillate product having improved low-temperature properties.

* * * * *